US008508408B2

(12) United States Patent
Quan et al.

(10) Patent No.: US 8,508,408 B2
(45) Date of Patent: Aug. 13, 2013

(54) METHOD AND APPARATUS FOR RECONFIGURING A PHOTONIC TR BEACON

(75) Inventors: Clifton Quan, Arcadia, CA (US); Michael D. Wabs, Placentia, CA (US)

(73) Assignee: Raytheon Company, Waltham, MA (US)

( * ) Notice: Subject to any disclaimer, the term of this patent is extended or adjusted under 35 U.S.C. 154(b) by 275 days.

(21) Appl. No.: 12/872,977

(22) Filed: Aug. 31, 2010

(65) Prior Publication Data

US 2012/0050106 A1 Mar. 1, 2012

(51) Int. Cl.
*H01Q 3/00* (2006.01)

(52) U.S. Cl.
USPC ..... 342/368

(58) Field of Classification Search
USPC ..... 342/368, 354, 376, 385, 423; 343/703
See application file for complete search history.

(56) References Cited

U.S. PATENT DOCUMENTS

| | | | | |
|---|---|---|---|---|
| 5,333,000 | A * | 7/1994 | Hietala et al. | 342/368 |
| 5,493,304 | A | 2/1996 | Lee et al. | |
| 5,771,019 | A | 6/1998 | Wachs et al. | |
| 6,347,001 | B1 * | 2/2002 | Arnold et al. | 398/122 |
| 6,954,173 | B2 | 10/2005 | Mrstik | |
| 7,133,001 | B2 | 11/2006 | Mrstik et al. | |
| 7,408,507 | B1 | 8/2008 | Paek et al. | |
| 7,439,901 | B2 | 10/2008 | Needham et al. | |
| 7,595,760 | B2 | 9/2009 | Lee et al. | |
| 2005/0001760 | A1 * | 1/2005 | Mrstik | 342/174 |
| 2010/0097277 | A1 | 4/2010 | Lee et al. | |

OTHER PUBLICATIONS

Extended European Search Report for European Application No. 11171999.3, Extended European Search Report dated Dec. 29, 2011 and mailed Jan. 5, 2012 (6 pgs.).

* cited by examiner

*Primary Examiner* — Harry Liu
(74) *Attorney, Agent, or Firm* — Christie, Parker & Hale, LLP

(57) ABSTRACT

A system and method for recalibrating a beacon for illuminating an antenna array, the system including an adjustable beacon configured to illuminate at least a portion of an array of antenna elements with a beacon signal, an element locator coupled to the antenna elements and configured to determine a location of a test element of the antenna elements with respect to a reference element of the antenna elements using RF phase sensing based upon the beacon signal as perceived by the test element and the reference element, a beam steering unit coupled between the adjustable beacon and the element locator and configured to cause the adjustable beacon to produce an adjusted beacon signal corresponding to the determined location of the test element and an antenna signal-to-noise ratio perceived by the beam steering unit, a photo-responsive element coupled to the adjustable beacon and configured to power the adjustable beacon, and a light source configured to illuminate the photo-responsive element.

20 Claims, 4 Drawing Sheets

METHOD AND APPARATUS FOR RECONFIGURING A PHOTONIC TR BEACON

STATEMENT REGARDING FEDERALLY SPONSORED RESEARCH

This invention disclosure is related to Government contract number FA8750-06-C-0048 awarded by the U.S. Air Force. The U.S. Government has certain rights in this invention.

BACKGROUND

The present invention relates to the field of antennas, and more particularly, to the field of antenna arrays.

Antenna array systems using mobile radar provide improved sensor performance for detecting and tracking multiple targets across large distances and with wide fields of regard. For phased antenna arrays, such as electronically scanned array (ESA) antennas, there is an emerging requirement to produce large, lightweight, flexible panel antenna arrays. Driving this requirement is the desire to increase capabilities of existing antenna array structures without affecting the performance of airships on which these antenna array structures may be used. However, flexible antenna array structures used in certain environments often experience a degree of deformation due to operating conditions. Accordingly, to maintain operability, system adjustments for correcting these deformations may be required. Thus, there is a desire to produce a large, lightweight, flexible antenna array system capable of performing the necessary adjustments to remain operable and efficient under conditions where deformation of the surface of the array occurs.

In conventional systems, as shown in U.S. Pat. No. 6,954,173, the concept of RF phase sensing may be applied to measure the shifting of antenna elements with respect to one another, and a beam steering computer may be used to redirect the focus of the shifted antenna elements. However, if the antenna array becomes sufficiently distorted, the coherent signal, which is produced by the fixed horn type beacon used to illuminate the antenna array, may not be effectively received by some of the antenna elements.

Another conventional approach for improving airship-based antenna array structures utilizes traditional coaxial cable and waveguide runs connected from the receiver to passive radiators used as RF beacons that measure the antenna array deformation. However, when the RF beacons are at larger distances from the antenna array, weight and signal quality become an issue.

Another approach has been to replace coaxial communications with wireless systems. Unfortunately, this has proven to be unsatisfactory due to the large degree of noise associated with multiple channels in a relatively small area for numerous elements.

Still another approach is using an RF amplifier to overcome RF losses from the coaxial cable and waveguide runs. However, this fails to address weight issues associated with large amounts of coaxial cable.

Yet another approach has been to use RF beacons with fixed beams. Unfortunately, such RF beacons have limited coverage and lack the ability to perform desired adjustments corresponding to deformations in the array.

SUMMARY

One aspect of exemplary embodiments of the present invention provides a method for calibrating one or more beacons observing antenna elements of an antenna array when deformations in the array arise. The calibration should improve communication between the one or more beacons and the antenna elements.

Another aspect of exemplary embodiments of the present invention utilize processes of phase shifting to determine a displacement of individual antenna elements that form the array.

Another aspect of exemplary embodiments of the present invention uses the determined displacement of the elements of the antenna array to adjust the signal of the one or more beacons and/or one or more antenna elements, thereby improving the efficiency of the array.

Another aspect of exemplary embodiments of the present invention utilizes fiber optic cables to power the one or more beacons by light, and to enable communication of the electronics of the antenna array with the antenna elements and the one or more beacons.

In accordance with one exemplary embodiment of the present invention, there is provided a reconfigurable antenna array system including an adjustable beacon configured to illuminate at least a portion of an array of antenna elements with a beacon signal, an element locator coupled to the antenna elements and configured to determine a location of a test element of the antenna elements with respect to a reference element of the antenna elements using RF phase sensing based upon the beacon signal as perceived by the test element and the reference element, a beam steering unit coupled between the adjustable beacon and the element locator and configured to cause the adjustable beacon to produce an adjusted beacon signal corresponding to the determined location of the test element and an antenna signal-to-noise ratio perceived by the beam steering unit, a photo-responsive element coupled to the adjustable beacon and configured to power the adjustable beacon, and a light source configured to illuminate the photo-responsive element.

The adjustable beacon may include a plurality of radiating elements.

The reconfigurable antenna array system may further include transverse cameras and an inertial measurement unit configured to locate the adjustable beacon relative to an inertial platform.

The reconfigurable antenna array system may further include at least one of a global positioning system, an attitude sensor, and a plurality of scatterers configured to locate the inertial platform.

The at least one of a global positioning system, an attitude sensor, and a plurality of scatterers may use an estimation algorithm to predict a location of the inertial platform and extrapolate information corresponding thereto to the beam steering unit.

The element locator may include phase shifters coupled to the test element and reference element and configured to convert perceived phases of the beacon signal received by the test element and reference element into phase-shifted signals, a decoder coupled to the phase shifters and configured to decode the phase-shifted signals and convert the phase-shifted signals into a phase-determined signal, and a phase unwrapping device coupled to the decoder and configured to convert the phase-determined signal into location data corresponding to the determined location of the test element with respect to the reference element.

The element locator may further include one or more amplifiers coupled between the phase shifters and the test element and the reference element and configured to amplify the perceived phases and deliver the amplified perceived phases to the phase shifters.

The element locator may include phase shifters modulated with unique frequency offsets corresponding to the beacon signal that are configured to directly measure a phase of the test element relative to a phase of the reference element, and a phase-unwrapping device coupled to the phase shifters and configured to convert the directly measured phases of the test element and the reference element into location data corresponding to the determined location of the test element with respect to the reference element.

The light source may be a laser that is coupled to a photovoltaic device configured to power the laser.

The reconfigurable antenna array system may further include a first wavelength division module coupled between the beam steering control unit and the beacon and a second wavelength division module coupled between the beam steering control unit and the element locator, wherein the wavelength division modules are coupled to the beacon and the element locator via electro-optic modulators and photodetectors at first ports and coupled to each other at second ports via optic fiber and antenna array control electronics.

In a further exemplary embodiment, there is provided a method of configuring an antenna array system having a beacon used to determine physical displacement of antenna elements of an antenna array, the method including illuminating the antenna elements with a beacon signal produced by the beacon, producing a plurality of signals corresponding to the beacon signal as sensed by the antenna elements, determining a location of a test element of the antenna elements with respect to a reference element of the antenna elements based upon the plurality of signals using RF phase sensing technology, performing a beam-steering correction based upon the determined location of the test element with respect to the reference element to shape and point the beacon signal to more effectively illuminate the antenna elements, and powering the beacon with light.

The beacon signal may include multiple simultaneous tones.

The location of the test element with respect to the reference element may be determined by modulating the plurality of signals with unique spinning rates corresponding to frequency offsets of the multiple simultaneous tones to produce phase-shifted signals, determining a phase difference between a first phase-shifted signal of the phase-shifted signals corresponding to the test element and a second phase-shifted signal of the phase-shifted signals corresponding to the reference element, and unwrapping the phase difference to produce location data.

Determining the phase difference between the first phase-shifted signal and the second phase-shifted signal may include summing the phase-shifted signals to create a wrapped signal, down-converting the wrapped signal to create a mixed signal, digitizing the mixed signal to create a digitized signal, and processing the digitized signal in a fast Fourier transform.

The plurality of signals may be amplified.

The method may further include compensating the phase difference corresponding to predicted array displacement and predicted propagation parameters, and calculating phase delay and time delay to improve accuracy of the location data.

The multiple simultaneous tones may include one or more individual frequency bands.

The one or more individual frequency bands may include X-band and UHF.

The method may further include locating the beacon relative to an inertial platform using transverse cameras and an inertial measurement unit, and locating the inertial platform relative to a position on earth using at least one of a global positioning system, an attitude sensor, and a plurality of scatterers.

In a further exemplary embodiment, there is provided a method of configuring an antenna array system having a beacon used to determine physical displacement of antenna elements of an antenna array, the method including emitting a beacon signal including multiple simultaneous tones in UHF band and X-band from a beacon, illuminating the antenna elements with the beacon signal, producing a plurality of signals corresponding to the beacon signal as sensed by the antenna elements, amplifying the plurality of signals, modulating the amplified plurality of signals with a unique spinning rate corresponding to frequency offsets of the multiple simultaneous tones to produce phase-shifted signals, summing the phase-shifted signals to create a wrapped signal, down-converting the wrapped signal to create a mixed signal, digitizing the mixed signal to create a digitized signal, processing the digitized signal in a fast Fourier transform to produce an FFT signal, using the FFT signal to determine a phase difference between a first phase-shifted signal corresponding to the test element and a second phase-shifted signal corresponding to the reference element, unwrapping the phase difference to produce inertial location data, using the inertial location data to determine a location of a test element of the antenna elements with respect to a reference element of the antenna elements, determining a location of the beacon with respect to an inertial platform using transverse cameras and an inertial measurement unit, determining a location of the inertial platform with respect to a position on earth using at least one of a global positioning system, an attitude sensor, and a plurality of scatterers, based upon the determined location of the test element with respect to the reference element, performing at least one of a beam-steering correction to shape and point the beacon signal to more effectively illuminate the antenna array and an element correction to adjust directivity of the antenna elements, and powering the beacon with light.

BRIEF DESCRIPTION OF THE DRAWINGS

The accompanying drawings, together with the specification, illustrate exemplary embodiments of the present invention, and, together with the description, serve to explain the principles of embodiments of the present invention. The above and other features and aspects of the present invention will become more apparent by describing in detail exemplary embodiments thereof with reference to the attached drawings in which.

DETAILED DESCRIPTION

Given a large and flexible antenna array, the array surface on which the antenna elements are disposed may generally become distorted during operation or after prolonged use, thereby causing changes of the physical location of the antenna elements with respect to one another. For example, an antenna array used at high altitudes in an airship may be attached to the hull of the airship. The antenna array may be subject to extreme changes in temperature, and the physical phenomenon of thermal expansion may cause distortion of the antenna array surface. Additionally, wind strength upon the airship, and even turbulence, may cause distortions in the surface of the antenna array, which may degrade the system's ability to maintain signal coherence. This may impact performance and accuracy of the antenna array structure.

In accordance with an exemplary embodiment of the present invention, a coherent signal is emitted by a beacon and subsequent signals emitted by the beacon are recalibrated corresponding to distortions in the antenna array surface, as determined by the system, in order to maintain effective operability of the antenna array structure.

Figure 1:
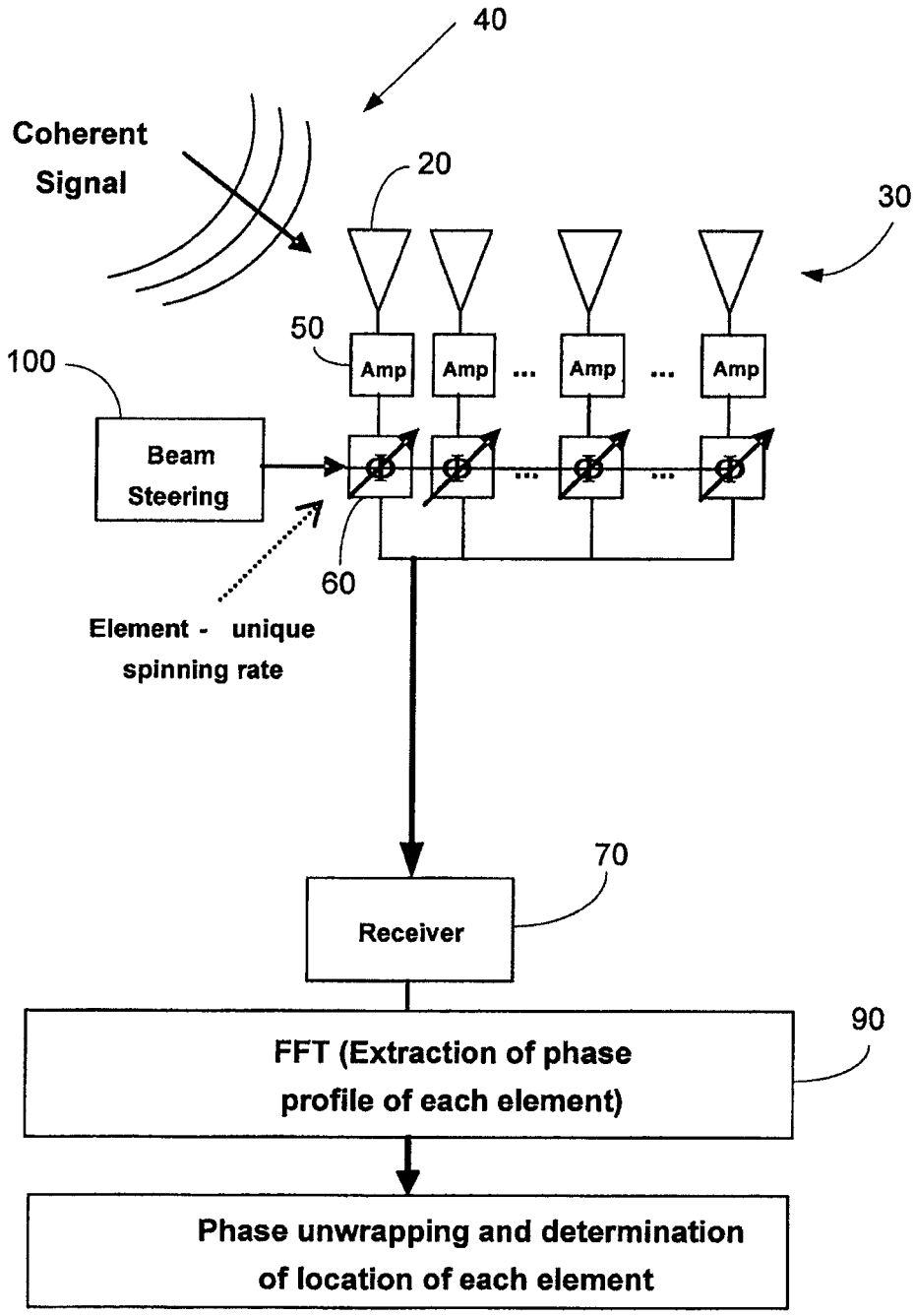
FIG. 1 is a schematic diagram illustrating the concept of RF phase sensing.

Referring to FIG. 1, a beacon 10 (shown in FIGS. 2-4), which may be mounted on the interior of an airship, illuminates antenna elements 20 of an antenna array structure 30 with a coherent signal 40. The various antenna elements 20 may receive the coherent signal 40 at different times due to variations in distance from the beacon 10, as the coherent signal 40 will take longer to reach antenna elements 20 that are further from the beacon 10. Depending on the proximity of the beacon 10 to the antenna elements 20, the coherent signal 40 may either be treated as a plane wave (e.g., if the beacon 10 is in the far field), or additional calculations using methods of digital signal processing may be used to account for the spherical aberration of the coherent signal 40, as depicted in FIG. 1 (e.g., if the beacon 10 is in close proximity to the antenna elements 20). Furthermore, each antenna element 20, which is capable of alternating between transmit and receive functionality, may be coupled to an amplifier 50 for the purpose of amplifying the coherent signal 40 received by the respective antenna elements 20, although such an amplifier 50 is not necessary for practice of the invention.

Coupled to each of the antenna elements 20 is a respective phase shifter 60, which modulates the plurality of signals corresponding to the coherent signal 40 as received by the antenna elements 20 with a unique spinning rate corresponding to frequency offsets of the received coherent signal 40. The coherent signal 40 may include multiple simultaneous tones, which are used to perform the modulation of the plurality of signals. The multiple simultaneous tones may be, for example, in the X-band and the UHF-band. The modulated signals may be referred to as phase-shifted signals.

The phase-shifted signals may then be combined (e.g., summed) by a transmit/receive module (e.g., a combiner) 70 to create a single signal, which may be referred to as a wrapped signal.

The wrapped signal may then be down-converted and then digitized using an analog-to-digital converter to create what may be referred to as a digitized signal. This digitized signal may be an in-phase quadrature signal.

The digitized signal may then be processed in a fast Fourier transform (FFT) 90, which may measure the complex envelope of each of the plurality of signals received by the antenna elements 20 at their phase-shifted frequency to create a complex FFT coefficient for each signal. The complex FFT coefficient may then be used to measure phase differences between antenna elements 20 (e.g., a test element and a reference element) having received the coherent signal 40.

The measured phase differences may then be unwrapped so that information corresponding to the different times in which the antenna elements 20 received the coherent signal may be converted into information indicating the location of two or more antenna elements 20 with respect to one another. Furthermore, the system may use methods known in the art for periodically correcting phase and time delays due to channel propagation. For example, phase compensation may be calculated from algorithms related to predicted displacement of the antenna elements 20. This information may then be used (e.g., by a beam steering computer 100) to determine if any adjustments should be made to subsequent signals emitted by either the beacon 10 or one or more of the antenna elements 20. If such adjustments are desired (e.g., to improve performance of the system), then a signal corresponding to an adjustment of RF antenna signals emitted by the antenna elements 20 may be sent to one or more of the antenna elements 20. The preceding information may also be used to enable the beacon 10 to "self-locate," in that the phase measurements of multiple antenna elements 20 may be combined to estimate the location of the beacon 10 in a similar manner.

A single beacon 10 producing a single coherent signal 40 allows the system to determine the relative location of antenna elements 20 only in the direction to the beacon's 10 source (e.g., a one-dimensional determination of displacement between the test element and the reference element). Therefore, second and third beacons (or more) may be added to allow a determination of the relative location of antenna elements 20 with respect to one another in three-dimensional space (e.g., by using triangulation methods). The beacon 10 or beacons may illuminate the antenna array structure 30 from an orthogonal direction, although it is not necessary to do so. Furthermore, a further increase in the number of beacons 10 may lead to greater accuracy in the measurement(s) of the locations of the antenna elements 20 (e.g., an "overdetermined" location measurement).

Although a beacon 10 should have some degree of directivity for the purpose of being directed toward one or more antenna elements 20, distortion of the surface of the antenna array structure 30 may cause one or more antenna elements 20 to fail to adequately receive the coherent signal 40, thereby possibly preventing an accurate determination of one or more antenna elements' 20 relative location by the system.

Accordingly, if it appears, based upon the aforementioned calculations, that the intended target or targets of the beacon 10 (e.g., the antenna elements 20) have moved, a beam-steering signal may be sent from a beam steering computer 100 to the digital control unit 105 of the beacon 10 in order to perform an adjustment so that subsequent coherent signals emitted by the beacon 10 may be more effectively directed at the beacon's 10 desired target or targets. The beam steering computer 100 may determine whether to send a beam-steering signal, and what type of beam-steering signal to send, based upon a measured signal-to-noise ratio, as may be perceived by the beam steering computer 100. The coherent signal 40 may be reconfigured through a variety of methods known in the art. Similarly, one or more of the antenna elements 20 may also be reconfigured so that the signals emitted therefrom may be changed to allow for increased operability of the antenna array structure 30.

Once the relative location of antenna elements 20 with respect to one another has been determined, metrology, and/or transverse cameras and an inertial measurement unit (IMU), may be used to determine the location of one or more beacons 10 relative to an inertial platform (e.g., within in airship housing the antenna array structure 30 and the beacon 10). An attitude sensor affixed to the inertial platform may be used in combination with a global positioning system to determine a location of the inertial platform with respect to a point on earth. The inertial platform may then be calibrated using radar ground maps of known large scatterers. However, it should be understood that these elements are not necessary for the practice of the present invention.

Figure 2:
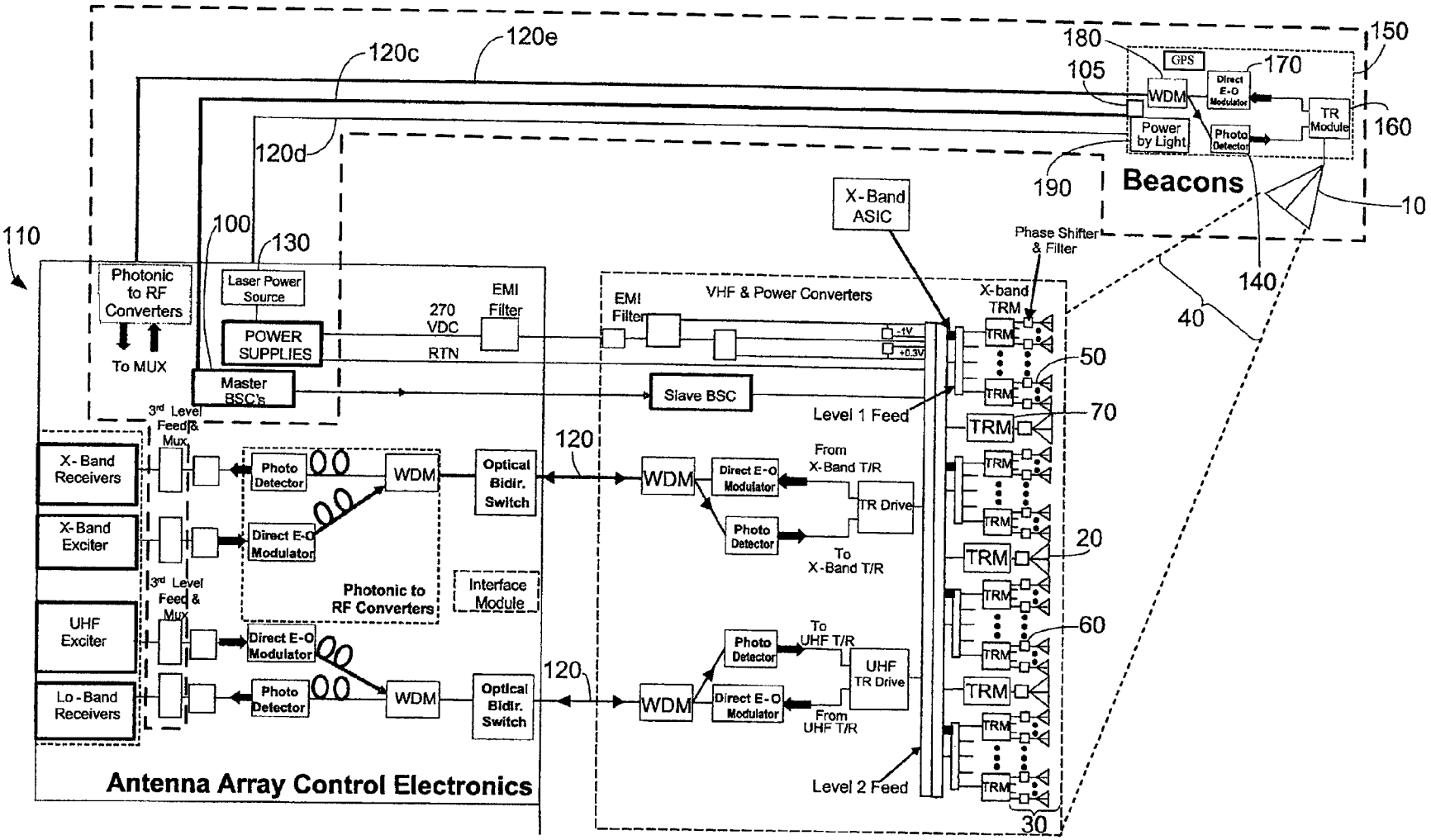
FIG. 2 is a schematic diagram illustrating various components of the antenna array system of one embodiment of the present invention.

Referring to FIG. 2, the individual antenna elements 20 may each operate over two different frequency bands, such as the X-band and UHF band. Furthermore, communication between the antenna elements 20 and the antenna array control electronics 110 may be accomplished via fiber optic cables 120, as numerous antenna elements 20 separated by substantial distances from the antenna array control electronics 110 may require large amounts of cable or fiber in order to effectively operate. As previously mentioned, the use of a fiber optics system allows for reductions in weight of the system, as compared to the use of coaxial cable, and with little signal attenuation, as compared to the use of wireless technology. In order to convert the RF signals received by the antenna elements 20 to corresponding optical signals to be sent to the antenna array control electronics 110, the methods of direct modulation and/or external modulation of the optical carrier signal may be used.

In direct modulation, a light emitting source such as 170 (e.g., a laser, or a light emitting diode) is provided with sufficient bias current to cause it to generate light (e.g., beyond its lazing threshold). The RF signal sought to be converted into a corresponding optical signal is then used to directly modulate the bias current, thereby amplitude modulating the optical signal in a fashion that is roughly linear with the RF signal. In direct modulation, higher frequencies may require the use of a thermo-electric cooling element (e.g., a thermistor-controlled Peltier cooling unit) coupled to the light emitting source 170 in order to maintain performance and wavelength stability (particularly in application with a Wavelength Division Multiplexing system), although such a device is not required to practice the present invention.

In external modulation, a continuous wave (CW) laser source may be used as the light emitting source 170, and may be applied to the input of an interferometer (e.g., a Mach-Zender interferometer, which may replace the directly modulated laser 170) where the beam is then split into two legs, and the RF signal is used to generate a phase difference in one leg of the split beam. The two legs are then recombined, creating an amplitude modulated optical signal at the output of the interferometer. External modulation can achieve superior performance to that of directly modulated links. In external modulation, however, the light emitting source 170 may need to be coupled to phase maintaining fiber as the fiber optic cable 120, which is generally more expensive than single mode fiber. Additionally, the performance of external modulation links strongly depends upon the CW laser source optical power level. Satisfactory performance typically requires greatly increased optical power, and thereby increased DC power consumption, as compared to directly modulated links.

In an embodiment of the present invention wherein the antenna elements 20 operate over the X-band and the UHF band, an externally modulated laser may be used as the light emitting source 170 in operations involving the X-band, and a directly modulated laser may be used as the light emitting source 170 in operations involving the UHF band. For both the externally modulated laser and the directly modulated laser, the optical signals may be converted back to RF signals (e.g., for use within the antenna array control electronics 110, or for the signals produced by the beacon 10 or antenna elements 20) using optical photodetectors 140 (e.g., photodiodes).

The light emitting source 130 may be solar powered. The light emitting source 130 may supply power the photonic TR beacon 150 by being coupled to the antenna array control electronics 110, which are in turn coupled to a photovoltaic device that receives light and converts the external optical power to electrical DC power, although such a photovoltaic device is not necessary to practice the invention. In an embodiment of the present invention, the light emitting source 130, as well as the antenna array structure 30, the beacon 10, and the antenna array control electronics 110 may be housed within an airship, while a solar panel including the photovoltaic device may be located on the exterior of the hull of the airship and coupled to the antenna array control electronics 110.

In accordance with another exemplary embodiment of the present invention, the beacon emitting the coherent signal 40 is powered by light via a photo-responsive element coupled to the beacon. The photo-responsive element may typically be a photovoltaic element, or any device suitable for enabling an electrical signal to be generated due to incident light. The photo-responsive element may be powered by a light source coupled to the photo-responsive element via a fiber optic cable, or may even be powered by an uncoupled freespace light source (e.g., a laser) calibrated to focus light on the photo-responsive element from a distance.

Figure 3:
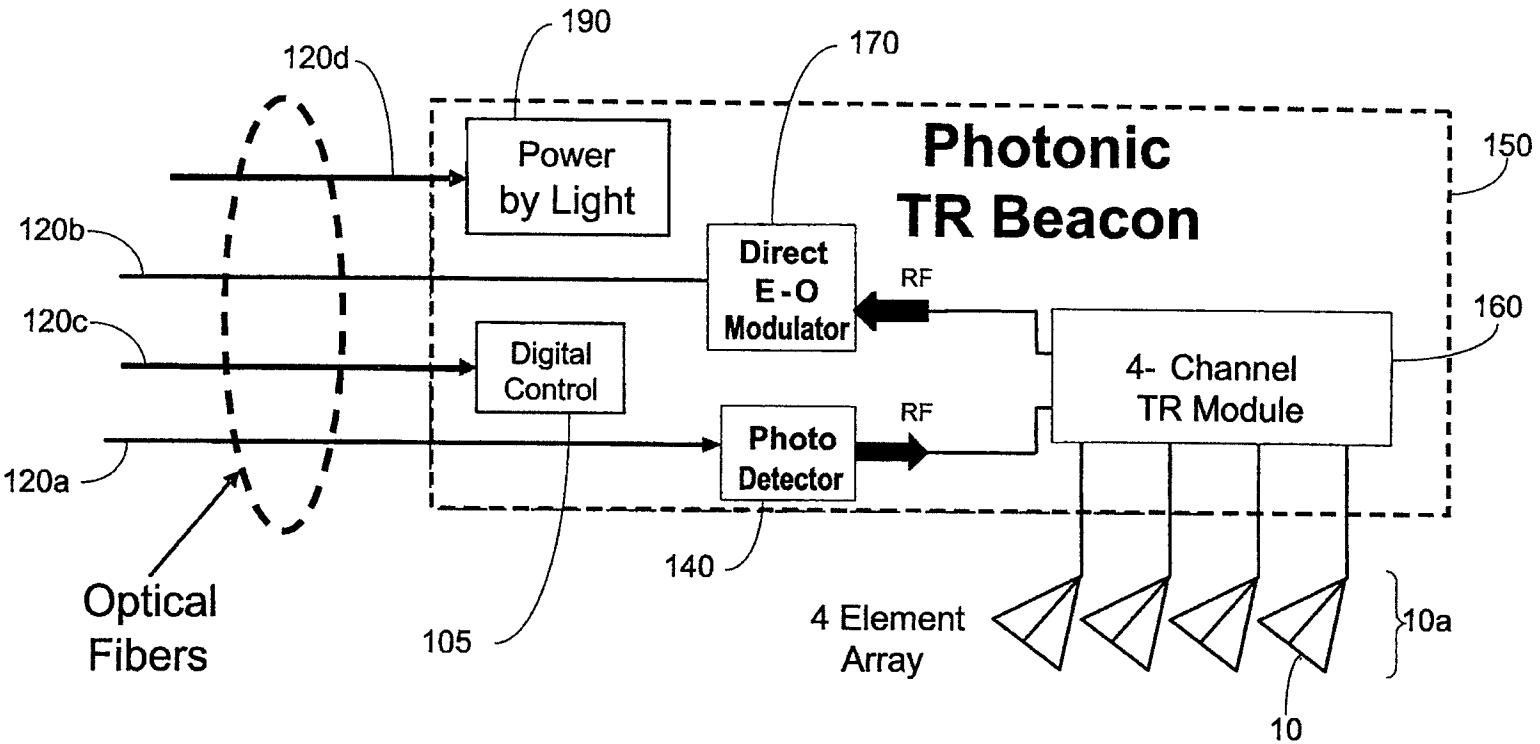
FIG. 3 is a schematic diagram of a photonic TR beacon of one embodiment of the present invention.
Figure 4:
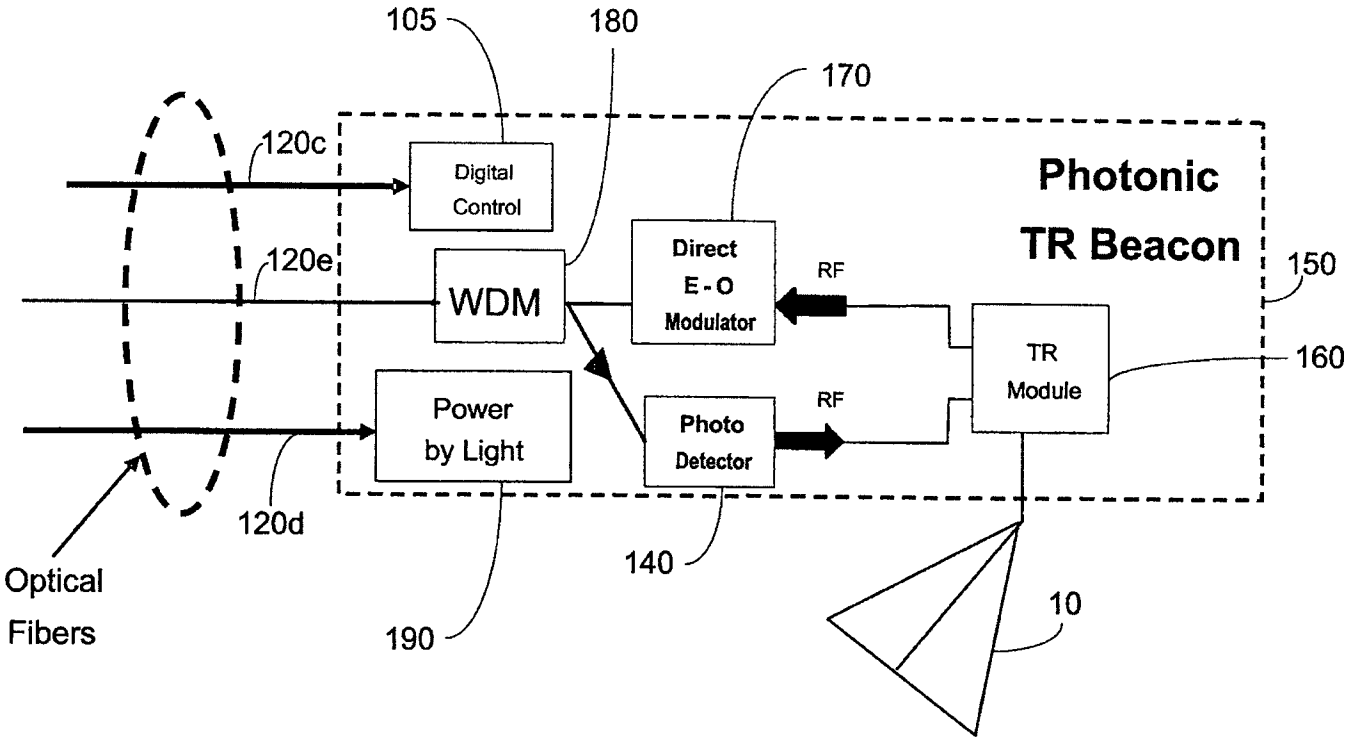
FIG. 4 is a schematic diagram of a photonic TR beacon of another embodiment of the present invention, wherein the photonic TR beacon circuitry utilizes a multiplexer in order to reduce the number of fiber optic cables associated with the photonic TR beacon.

Referring to FIGS. 3 and 4, the circuitry of the beacon 10 (collectively, the photonic TR beacon 150) is coupled to fiber optic cables 120. As shown in FIG. 3, the photonic TR beacon 150 may be coupled to four fiber optic cables 120.

A first fiber optic cable 120*a* is used for receiving an optical signal from the antenna array control electronics 110 corresponding to an RF signal to be emitted by the beacon 10 (i.e., the RF radiating element 10 of the photonic TR beacon 150). This first fiber optic cable 120*a* is coupled to a photodetector 140 to convert the optic signal to a corresponding RF signal, as previously mentioned, and the RF signal may be transferred to the beacon 10 via a transmit/receive module 160.

The transmit/receive module 160 may also be coupled to an electro-optic modulator 170, which may include the aforementioned directly modulated light emitting source 170, to optically transmit RF signals received by the beacon 10 to the antenna array control electronics 110 via a second additional fiber optic cable 120*b*. The photonic TR beacon 150 may also include a digital control unit 105 coupled to a third fiber optic cable 120*c*. The digital control unit 105 may receive beam-steering signals from the beam steering computer 100, thereby causing the photonic TR beacon 150 to adjust the RF radiating element 10 according to the beam-steering signal.

A fourth fiber optic cable 120*d* may be used to deliver power from the antenna array control electronics 110 to a photo-responsive element 190 of the photonic TR beacon 150, which may consist of single mode fiber (SMF), or a less expensive multi-mode optical fiber (MMF). The fourth fiber optic cable 120*d* may similarly be coupled to a light emitting source 130, such as a laser, which will receive its power via the antenna array control electronics 110 (e.g., via solar power, as mentioned above). As previously mentioned, embodiments of the invention may be practiced in the absence of a fourth fiber optic cable 120*d*. For example, a laser may be calibrated to focus a beam of energy on the photo-responsive element 190 from a distance.

Referring to FIG. 4, in accordance with another embodiment of the present invention, fiber multiplexing is used. The photonic TR beacon 150 of the embodiment of the invention shown in FIG. 4 operates much in the same manner as that shown in FIG. 3. However, the first and second fiber optic cables 120*a* and 120*b* are combined to a single mode fiber (SMF) 120*e* that is coupled to a wavelength division module, or WDM, 180. The WDM 180 may be used to both combine and separate different signals of different frequencies, which may both be transmitted along the SMF 120*e* (e.g., combining two different optical signals at one port, and separating two different optical signals received at another port). For example, the two different optical signals may include a forward signal and a reverse signal, which may both travel along the single fiber optic cable 120*e* without degradation of the information contained therein (e.g., with minimal crosstalk and/or with immunity to electro-magnetic interference and radio frequency interference). Similar WDMs may be used in association with any or all of the antenna elements 20, the antenna array control electronics 110, and/or the beacons 10.

The WDM 180 is in turn coupled to the electro-optic modulator 170 and the photodetector 140, and is used to send both a forward and reverse signal along the SMF 120*e*. The SMF 120*e* is superior to traditional copper wires, in that coaxial interconnections to the antenna array control electronics 110, as well as the potential for electro-magnetic interference, are eliminated.

In one embodiment of the present invention, a first channel for either the reverse or forward signal may be carried on light having a wavelength of 1310 nm, and a second channel for the other signal (i.e., the signal not carried on the first channel) may be carried on light having a wavelength of 1550 nm. Furthermore, additional channels may be added by using different multiplexing technologies, such as coarse wavelength division multiplexing, which allows for 8 channels per fiber, or dense wavelength division multiplexing, which allows for 80 channels or more per fiber, as limited by system concerns for wavelength stability of the electro-optic source (e.g., increased multiplexing may necessitate use of the previously mentioned Peltier coolers, thereby increasing cost and complexity). Similar aggressive multiplexing schemes could be used to reduce fiber links between adjacent Photonic TR beacons, as desired. However it should be understood that the present invention may be practiced in the absence of multiplexing, wherein separate fiber optic cables are used for each channel or fiber optic power supply. Furthermore, it should be understood that the preceding are given merely as examples, and the invention is not limited thereto.

It should also be noted that additional RF radiating elements (e.g., beacons 10) may be added to the photonic TR beacon 150, and coupled to the transmit/receive module 160, in order to create a beacon array 10*a*.

As antenna array structures 30 increase in size, the distance between the antenna array control electronics 110, to which the beacon 10 or array of beacons 10*a* are also coupled, may also increase. Accordingly, the amount of cables and waveguides necessary to operate a system having the aforementioned features may also increase, resulting in increased weight to the system and potential decrease in signal quality. By using fiber optic cables 120, weight and signal loss concerns, as well as concerns associated with system performance sensitivity due to variations in distance, may be addressed.

While the present invention has been particularly shown and described with reference to exemplary embodiments thereof, it will be understood by those of ordinary skill in the art that features of different embodiments may be combined to form further embodiments, and that various changes in form and details may be made therein, without departing from the spirit and scope of the present invention as defined by the following claims.

What is claimed is:

1. A reconfigurable antenna array system comprising:

an adjustable beacon configured to illuminate at least a portion of an array of antenna elements with a beacon signal;

an element locator coupled to the antenna elements and configured to determine a location of a test element of the antenna elements with respect to a reference element of the antenna elements in three-dimensional space using RF phase sensing based upon the beacon signal as perceived by the test element and the reference element;

a beam steering computer coupled between the adjustable beacon and the element locator and configured to cause the adjustable beacon to produce an adjusted beacon signal corresponding to the determined location of the test element or corresponding to an antenna signal-to-noise ratio calculated by the beam steering computer;

a photo-responsive element coupled to the adjustable beacon and configured to power the adjustable beacon; and a light source configured to illuminate the photo-responsive element.

2. The reconfigurable antenna array system of claim 1, wherein the adjustable beacon comprises a plurality of radiating elements.

3. The reconfigurable antenna array system of claim 1 further comprising transverse cameras and an inertial measurement unit configured to locate the adjustable beacon relative to an inertial platform coupled to the antenna elements.

4. The reconfigurable antenna array system of claim 3 further comprising at least one of a global positioning system, an attitude sensor coupled to the inertial platform, and a plurality of scatterers configured to locate the inertial platform.

5. The reconfigurable antenna array system of claim 4, wherein the at least one of a global positioning system, an attitude sensor, and a plurality of scatterers uses an estimation algorithm to predict a location of the inertial platform and extrapolates information corresponding thereto to the beam steering computer.

6. The reconfigurable antenna array system of claim 1, wherein the element locator comprises:

phase shifters coupled to the test element and reference element and configured to convert perceived phases of the beacon signal received by the test element and reference element into phase-shifted signals;

a decoder coupled to the phase shifters and configured to decode the phase-shifted signals and convert the phase-shifted signals into a phase-determined signal; and a phase unwrapping device coupled to the decoder and configured to convert the phase-determined signal into location data corresponding to the determined location of the test element with respect to the reference element.

7. The reconfigurable antenna array system of claim 6, wherein the element locator further comprises:

one or more amplifiers coupled between the phase shifters and the test element and the reference element and configured to amplify the perceived phases and deliver the amplified perceived phases to the phase shifters.

8. The reconfigurable antenna array system of claim 1, wherein the element locator comprises:

phase shifters modulated with unique frequency offsets corresponding to the beacon signal that are configured to directly measure a phase of the test element relative to a phase of the reference element; and a phase-unwrapping device coupled to the phase shifters and configured to convert the directly measured phases of the test element and the reference element into location data corresponding to the determined location of the test element with respect to the reference element.

9. The reconfigurable antenna array system of claim 1, wherein the light source is a laser that is coupled to a photovoltaic device configured to power the laser.

10. The reconfigurable antenna array system of claim 1 further comprising:

a first wavelength division module coupled between the beam steering control unit and the beacon and a second wavelength division module coupled between the beam steering control unit and the element locator, wherein the wavelength division modules are coupled to the beacon and the element locator via electro-optic modulators and photodetectors at first ports and coupled to each other at second ports via optic fiber and antenna array control electronics.

11. A method of configuring an antenna array system having a beacon used to determine three-dimensional physical displacement of antenna elements of an antenna array, the method comprising:

illuminating the antenna elements with a beacon signal produced by the beacon;

producing a plurality of signals corresponding to the beacon signal as sensed by the antenna elements;

determining a location of a test element of the antenna elements with respect to a reference element of the antenna elements based upon the plurality of signals using RF phase sensing technology;

performing a beam-steering correction based upon the determined location of the test element with respect to the reference element to shape and point the beacon signal to more effectively illuminate the antenna elements; and powering the beacon with light.

12. The method of claim 11, wherein the beacon signal comprises multiple simultaneous tones.

13. The method of claim 12, wherein the location of the test element with respect to the reference element is determined by:

modulating the plurality of signals with unique spinning rates corresponding to frequency offsets of the multiple simultaneous tones to produce phase-shifted signals;

determining a phase difference between a first phase-shifted signal of the phase-shifted signals corresponding to the test element and a second phase-shifted signal of the phase-shifted signals corresponding to the reference element; and unwrapping the phase difference to produce location data.

14. The method of claim 13, wherein determining the phase difference between the first phase-shifted signal and the second phase-shifted signal comprises:

summing the phase-shifted signals to create a wrapped signal;

down-converting the wrapped signal to create a mixed signal;

digitizing the mixed signal to create a digitized signal; and processing the digitized signal in a fast Fourier transform.

15. The method of claim 13, wherein the plurality of signals are amplified.

16. The method of claim 13, further comprising:

establishing predicted array displacement and predicted propagation parameters using at least one algorithm;

compensating the phase difference corresponding to the predicted array displacement and predicted propagation parameters; and calculating phase delay and time delay to improve accuracy of the location data.

17. The method of claim 12, wherein the multiple simultaneous tones comprise one or more individual frequency bands.

18. The method of claim 17, wherein the one or more individual frequency bands comprise X-band and UHF.

19. The method of claim 11 further comprising:

locating the beacon relative to an inertial platform using transverse cameras and an inertial measurement unit; and locating the inertial platform relative to a position on earth using at least one of a global positioning system, an attitude sensor coupled to the inertial platform, and a plurality of scatterers.

20. A method of configuring an antenna array system having a beacon used to determine three-dimensional physical displacement of antenna elements of an antenna array, the method comprising:

emitting a beacon signal comprising multiple simultaneous tones in UHF band and X-band from a beacon;

illuminating the antenna elements with the beacon signal;

producing a plurality of signals corresponding to the beacon signal as sensed by the antenna elements;

amplifying the plurality of signals;

modulating the amplified plurality of signals with a unique spinning rate corresponding to frequency offsets of the multiple simultaneous tones to produce phase-shifted signals;

summing the phase-shifted signals to create a wrapped signal;

down-converting the wrapped signal to create a mixed signal;

digitizing the mixed signal to create a digitized signal;

processing the digitized signal in a fast Fourier transform to produce an FFT signal;

using the FFT signal to determine a phase difference between a first phase-shifted signal corresponding to the test element and a second phase-shifted signal corresponding to the reference element;

unwrapping the phase difference to produce inertial location data;

using the inertial location data to determine a location of a test element of the antenna elements with respect to a reference element of the antenna elements;

determining a location of the beacon with respect to an inertial platform using transverse cameras and an inertial measurement unit;

determining a location of the inertial platform with respect to a position on earth using at least one of a global positioning system, an attitude sensor, and a plurality of scatterers;

based upon the determined location of the test element with respect to the reference element, performing at least one of a beam-steering correction to shape and point the beacon signal to more effectively illuminate the antenna array and an element correction to adjust directivity of the antenna elements; and powering the beacon with light.

* * * * *